United States Patent [19]

Ybarra

[11] Patent Number: 4,835,923

[45] Date of Patent: Jun. 6, 1989

[54] MOVABLE WALL ASSEMBLY

[76] Inventor: Robert Ybarra, 553 W. Comstock Ave., Glendora, Calif. 91740

[21] Appl. No.: 71,374

[22] Filed: Jul. 9, 1987

[51] Int. Cl.[4] ..... E04B 2/30

[52] U.S. Cl. ..... 52/238.1; 52/764; 52/489; 52/481; 52/483; 52/DIG. 5

[58] Field of Search ..... 52/238, 241, 481, 483, 52/DIG. 4, 764, 238.1, 489; 335/285; 248/706.5; 292/251.5; 24/303

[56] References Cited

U.S. PATENT DOCUMENTS

| | | | |
|---|---|---|---|
| 2,635,237 | 4/1953 | Langer | 335/285 |
| 2,991,789 | 7/1961 | Smith et al. | 248/206.5 |
| 3,292,328 | 12/1966 | Lewis et al. | 52/DIG. 4 |
| 3,331,043 | 7/1967 | Orzabal | 292/251.5 |
| 3,514,731 | 5/1970 | Drake | 335/285 |
| 3,518,884 | 7/1970 | Wood et al. | 248/206.5 |
| 3,852,935 | 12/1974 | Jones | 52/DIG. 4 |

*Primary Examiner*—James L. Ridgill, Jr.
*Attorney, Agent, or Firm*—Boniard I. Brown

[57] ABSTRACT

A movable wall or partition assembly having panels magnetically secured to studs by novel magnetic clips on the studs engaging magnetic means on the panels, whereby one or more panels may be quickly and easily removed and replaced without disturbing the remaining panels or the entire wall or partition assembly may be disassembled, even by office personel, for movement or storage. A novel magnetic clip for the wall or partition assembly which does not require any special stud configuration for the assembly.

15 Claims, 2 Drawing Sheets

MOVABLE WALL ASSEMBLY

BACKGROUND OF THE INVENTION

1. Field of the Invention:

This invention relates generally to building walls and partitions and more particularly to a novel wall or partition assembly having magnetically secured wall panels which may be easily removed and replaced, even by office personel. The invention relates also to a novel magnetic clip for the assembly.

2. Discussion of the Prior Art:

One construction technique which is commonly used in constructing offices and other compartmented building structures involves the use of movable partitions or walls which may be relatively easily moved from one location to another and stored when not in use. A variety of movable wall systems of this kind have been devised.

Simply stated, a movable wall system, or wall assembly as it is referred to herein, comprises a floor runner to be secured to the floor, a header to be secured to the ceiling, in most but not all cases, studs extending between the runner and header, and wall panels extending between the runner and header and disposed edge to edge to form a wall surface. Some installations require wall panels on only one side of the wall assembly. Other installations require wall panels on both sides of the wall assembly.

One of the problems involved in designing a movable wall assembly involves releasably mounting the wall panels to the assembly in such a way that the panels may be easily removed and replaced. A variety of wall panel mounting means have been devised for this purpose. One mounting technique utilizes magnetic attraction to releasably hold the wall panels in place.

Examples of magnetic wall panel mountings are described in the following patents.

U.S. Pat. No 3,986,312 to Calhoun, et al.:

Describes a movable wall assembly in which the wall panels mount magnetic strips which engage within longitudinal grooves in magnetic wall studs to magnetically secure the panels to the studs.

U.S. Pat. No. 3,852,935 to Jones:

Describes a movable wall assembly in which wall studs have longitudinal grooves containing magnetic strips which engage magnetic strips on the wall panels to magnetically secure the panels to the studs.

U.S. Pat. No. 3,982,370 to Buffington:

Describes a movable wall assembly in which the wall panels mount magnetic strips which engage magnetic studs to magnetically secure the panels to the studs.

U.S. Pat. No. 3,292,328 to Lewis, et al.:

Describes a movable wall assembly having a floor runner for receiving and confining the lower edges of the wall panels and magnetic means on the header and wall panels for magnetically securing the panels to the header.

SUMMARY OF THE INVENTION

This invention provides an improved movable wall assembly embodying improved magnetic wall panel mounting means. These magnetic panel mounting means are uniquely constructed and arranged to permit removal and replacement of individual wall panels by relatively unskilled persons, such as office personnel, without disturbing the adjacent panels.

A primary feature of the invention resides in magnetic clips which are attached to wall studs and contact magnetic means on the wall panels to magnetically hold the panels to the studs. Each magnetic clip includes a bracket to be secured to a wall stud and magnetic means on the bracket engaging magnetic means on a wall panel for magnetically holding the panel to the stud. In the presently preferred embodiment of the invention, the magnetic clip bracket has a mounting portion to be secured to the side of the stud which faces the wall panel and at least one end portion extending laterally beyond and toward the opposite side of the stud. This end portion of the bracket mounts the magnetic means of the clip with one side of the magnetic means substantially coplanar with the bracket mounting portion and engaging the magnetic means on the wall panel to magnetically hold the panel in place.

The particular magnetic clip disclosed is designed to magnetically secure two wall panels to a common stud with edge portions of the panels overlying the stud. The clip has two end portions extruding in opposite lateral directions beyond and toward the opposite side of the stud. Each end portion mounts magnetic means which contact magnetic means on the adjacent wall panel to magnetically secure the panel to the stud. Two specific double end bracket configurations are described.

The complete wall assembly of the invention comprises a floor runner secured to the lower ends of the wall studs and a ceiling header secured to the upper ends of the studs. The ceiling header has channels which receive the upper ends of the wall panels. The floor runner has flanges which seat the lower ends of the panels. The panels are magnetically secured to the studs in such a way that each panel may be removed and replaced without disturbing the adjacent panels.

DESCRIPTION OF PREFERRED EMBODIMENT

Figure 1:
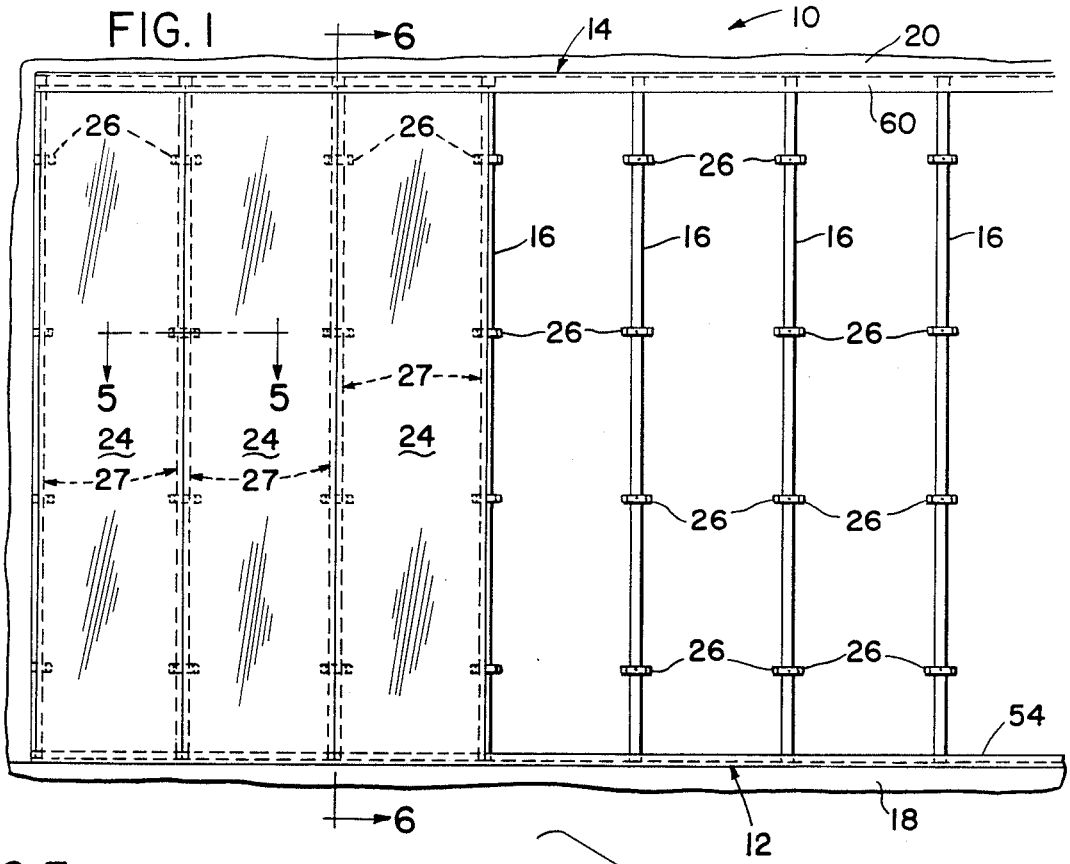
FIG. 1 is a side elevation of a movable wall assembly according to the invention with some wall panels removed to expose the wall studs and magnetic clips according to the invention.

Referring now to these drawings and first to FIGS. 1–6, there is illustrated an improved wall assembly 10 according to the invention. Wall assembly 10 includes a floor runner 12, a ceiling header 14, and studs 16 extending between the runner and header, when the wall assembly is installed, the runner is secured to the floor 18 and the header to the ceiling 20 by screws 22. One or both sides of the wall assembly is/are covered by wall panels 24. In the particular wall assembly shown, wall panels are installed on one side only of the wall assembly, although the broken lines illustrate that wall panels may be installed on both sides.

According to the present invention, the wall panels 24 are held in place in the wall assembly magnetically in such a way that the panels may be removed and replaced quickly and easily by even unskilled persons, such as office workers, to permit movement of the wall assembly from one place to another as well as storage of the wall when not in use. Moreover, any selected wall panel may be removed and replaced without disturbing the adjacent panels.

To these ends, the invention provides novel magnetic clips 26 which are mounted on the wall studs 16 and cooperate with magnetic means 27 on the wall panels 24 to secure the panels to the wall assembly. These magnetic clips constitute a primary feature of the invention.

Each magnetic clip 26 comprises a bracket 28 and magnetic means 30 on the bracket which cooperate with the wall panel magnetic means 26 to magnetically secure the adjacent wall panels to the wall assembly.

Referring now in more detail to the magnetic clips 26, each clip bracket 28 has a flat mounting portion 32 and at least one end portion 34 which is turned relative to the mounting portion so as to extend beyond one side, the normally rear or back side, of the mounting portion. The clip bracket is attached to a wall stud 16 with the bracket mounting portion 32 seating against the side of the stud facing the respective wall panels 24 and with the bracket end portion or portions extending laterally beyond and toward the opposite side of the stud.

Depending on the arrangement of a wall assembly 10, it may have one or two extreme end studs 16, such as the lefthand stud in FIG. 1. The bracket 28 of a magnetic clip 24 for installation on such an end stud may have either one or two end portions 34 depending upon the wall arrangement and the space available between the end stud and any adjacent structure. In any event, a magnetic clip 24 will be mounted on such an end stud with its single end portion 34 or one end portion extending beyond the stud toward the adjacent intermediate stud of the wall assembly, i.e., beyond the right side of the left-most stud in FIG. 1 toward the second from the left stud.

The magnetic means 30 of the magnetic clip 24 comprise a magnetic member 36 on each bracket end portion 34. The magnetic means 27 on each wall panel 24 comprise magnetic members 38, in this case magnetic strips, secured to the back side of each wall panel 24 adjacent to its vertical edges. The magnetic clips 26 and magnetic members are arranged in such a way that when a wall panel is placed in position on the wall assembly the panel is held in place by the magnetic attraction between the clip and panel members.

In the embodiment of FIGS. 1–6, the magnetic clip bracket 28 has a flat mounting portion 32. Each bracket end portion 34 includes a section 40 at right angles to and extending beyond the rear side of the mounting portion and an out-turned terminal portion 42 parallel to the mounting portion. Each magnetic member 36 of the magnetic clip 26 comprises a magnet assembly flat rectangular permanent magnet 44 between two flat rectangular, magnetically permeable pole plates 46 which project edgewise slightly beyond the edges of the magnet.

Each magnetic assembly 36, or magnet as it will be hereafter referred to, is secured, face to face, to the outer side of a right angle end section 40 of the clip bracket 28 by a fastener 48. Each magnet 36 has one edge adjacent and parallel to its bracket terminal portion 42 which keeps the magnet from turning on the fastener 48. The opposite edge off the magnet is substantially coplanar with and preferably projects just slightly beyond the bracket mounting portion 32. Each fastener 48 loosely secures its magnet 36 to the respective bracket end section 40 in such a way that the magnet has limited freedom of movement both edgewise and parallel to the fastener 48. The bracket is constructed of a non-magnetic material so as to not restrict this freedom.

Figure 3:
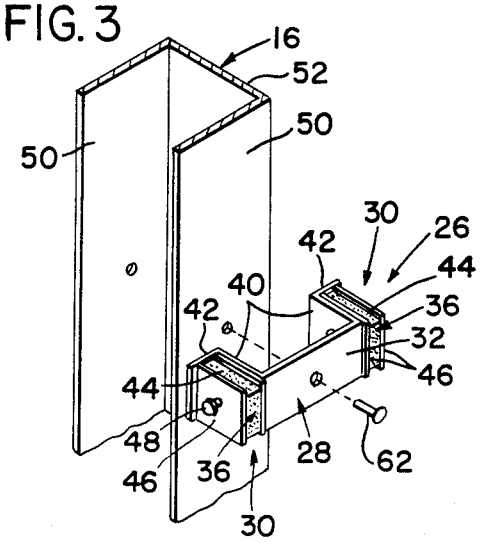
FIG. 3 is a fragmentary exploded perspective view of a wall stud and magnetic clip.
Figure 2:
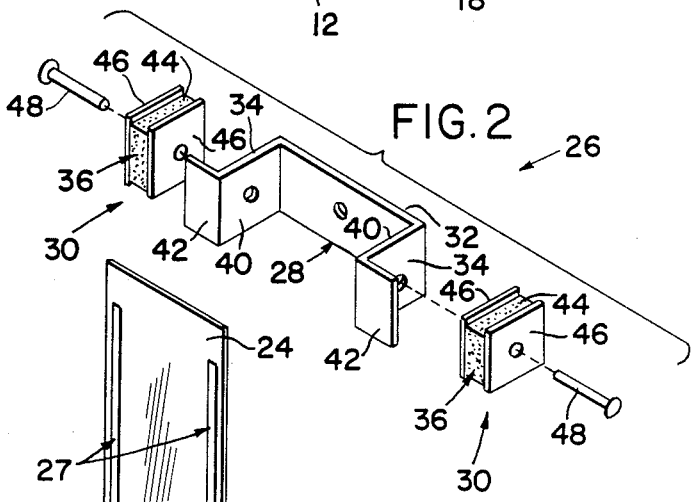
FIG. 2 is an enlarged exploded perspective view of a magnetic clip.
Figure 4:
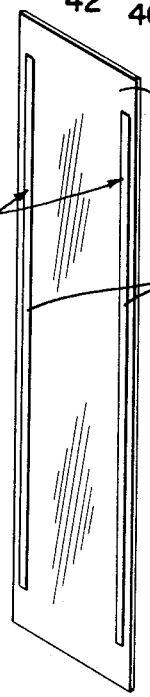
FIG. 4 is a perspective view of the inner or back side of a wall panel illustrating the magnetic means on the panel which cooperate with the magnetic clips of the invention to magnetically secure the panel to the wall studs.

As shown best in FIG. 3, each wall stud 16 is a channel having parallel flanges 50 joined by a web 52. The floor runner 12 is an upwardly opening channel having upstanding flanges 54 joined by a web 56 which seats on and is secured to the floor 18. The ceiling header 14 is an extrusion having inner depending flanges which are slotted at intervals to form pairs of laterally aligned depending fingers 58, and outer depending flanges 60.

The studs are vertically positioned, usually at uniform intervals, along the floor runner 12 and ceiling header 14 with the stud flanges 50 parallel to the sides of the wall assembly. The lower ends of the studs are positioned within and secured to the floor runner channel, as shown best in FIG. 6. The upper stud ends are positioned within the ceiling header channel with the header fingers 58 positioned between and secured to the stud flanges 50.

Figure 5:
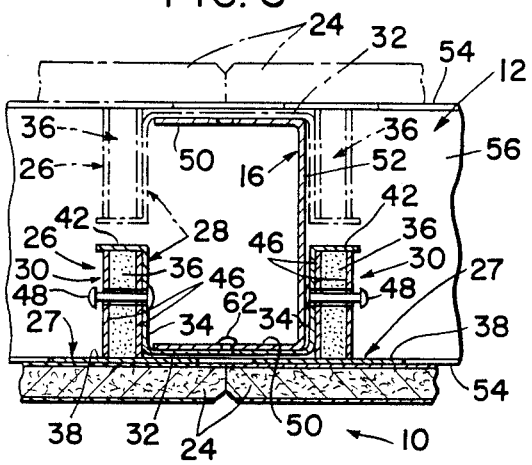
FIG. 5 is an enlarged section taken on line 5—5 in FIG. 1.
Figure 6:
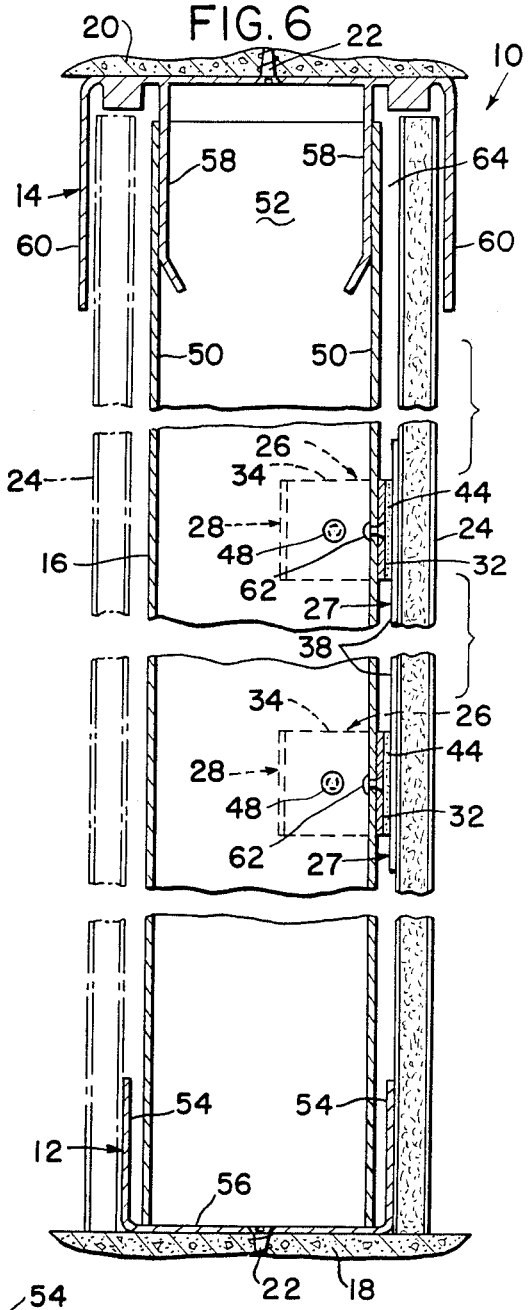
FIG. 6 is an enlarged section taken on line 6—6 in FIG. 1.

Each magnetic clip 26 is mounted on its stud at the side of the stud, i.e., the stud flange 50, to which wall panels 24 are to be installed. In the drawings, this is the front side in FIG. 1, bottom side in FIG. 5 and right side in FIG. 6. As mentioned earlier and shown in broken lines in FIGS. 5 and 6, however, wall panels may be installed on both sides of the wall assembly. Referring particularly to FIGS. 3 and 5, each magnetic clip is placed on its stud with the mounting portion 32 of the clip bracket 28 seating against the adjacent stud side or flange and with its end portions 34 extending laterally beyond and toward the opposite side of the stud in straddling relation to the stud. As mentioned earlier, the magnetic clips mounted on the end studs, such as the left-hand stud in FIG. 1, may have only one bracket end portion and magnet. Each clip is secured to its stud by a fastener 62 extending through the clip bracket mounting portion 32 and adjacent stud flange 50. Several magnetic clips 26 are mounted along each stud.

The width of the wall panels 24 substantially equals the center-to-center spacing between the studs 16. The wall panels are installed on the wall assembly with their upper ends engaging within the space 64 between the ceiling header fingers 58 and outer flanges 60 and their lower ends close to or seating against the floor runner flanges 54. The several wall panels are disposed edge to edge with the adjacent vertical edges of each pair of adjacent panels overlying a common intervening stud 16 and with the adjacent magnetic members or strips 38 on the panel in contact with the adjacent magnetic clip magnets 36.

The wall panels 24 are thus magnetically held in place in the wall assembly by the magnetic attraction between the magnetic clips 26 and wall panel magnetic members 38. The panels may be quickly and easily removed by pulling outwardly on the lower ends of the panels sufficiently to enable the upper panel ends to be withdrawn from the ceiling header space 64. In this regard, it will be observed in FIG. 6, that the width of the space 64 is greater than the thickness of the panels so as to enable the lower ends of the panels to be pulled outwardly. Installation of the panels is accomplished by reversing this procedure. Since adjacent panels do not interfit in any way, any one or more panels may be removed and replaced without disturbing the adjacent panels.

Figure 7:
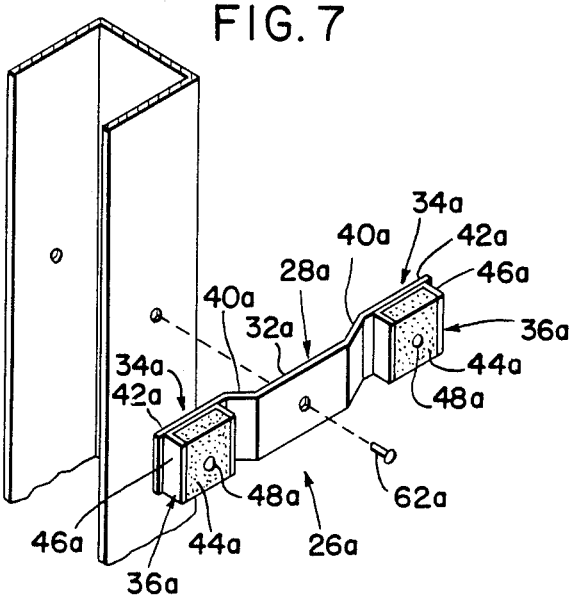
FIG. 7 is an exploded perspective view of a wall stud and a modified magnetic clip according to the invention.
Figure 8:
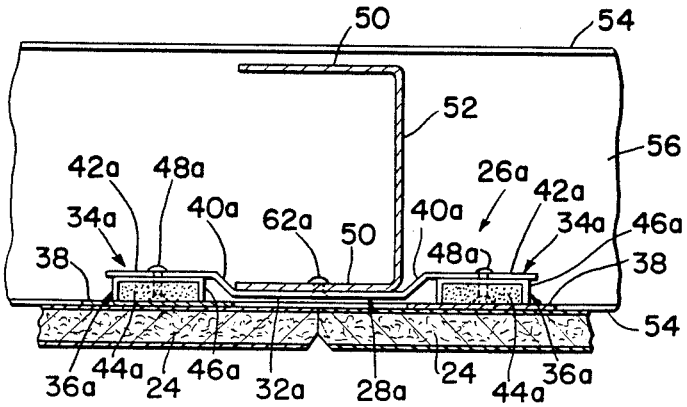
FIG. 8 is a section similar to FIG. 5 through a wall assembly embodying the modified magnetic clip of FIG. 7.

The modified magnetic clip 26*a* of FIGS. 7 and 8 is similar to the magnetic clip 26 and like the latter clip includes a non-magnetic bracket 28*a* having a mounting portion 32*a* and end portions 34*a* offset to the same side of the mounting portion. Each clip end portion 34*a* has an end section 40*a* and a terminal section 42*a*. Unlike clip 26, the terminal sections 42*a* of clip 26*a* are disposed in a common plane parallel to and offset to one side (the rear side) of the clip mounting portion 32*a*. Each clip magnet 36*a* is generally flat and rectangular and includes a magnetic channel 46*a* containing a permanent magnet 44*a* and is loosely secured to a clip bracket end section 42*a* by a fastener 48*a*. The magnets 36*a* are disposed substantially in a common plane parallel to the clip bracket mounting portion 32*a* with their front faces substantially flush with or, preferably, projecting slightly forwardly of the mounting portion.

The modified magnetic clip 26*a* is installed on a stud 16 in the same way as the magnetic clip 26 with the clip mounting portion 32*a* secured to the stud by a fastener 62*a* and with the clip bracket end portions 42 extending laterally beyond and toward the opposite side of the stud. The clip magnets 36*a* engage the magnetic members or strips 38 on the adjacent wall panels to magnetically hold the panels in position.

The inventor claims:

1. In a wall assembly, the combination comprising:

a stud, a wall panel, at least one magnetic clip on said stud including a non-magnetic bracket fixed to said stud, and magnetic means mounted on said bracket, magnetic means on said panel magnetically secured to said magnetic clip, and wherein said clip magnetic means is loosely mounted on said bracket for limited floating movement relative to the bracket edgewise of said panel.

2. In a wall assembly, the combination comprising:

a stud, a wall panel, at least one magnetic clip on said stud including a bracket fixed to said stud, and magnetic means mounted on said bracket, magnetic means on said panel magnetically secured to said magnetic clip, said stud has a longitudinal side facing said panel, said clip bracket has a flat elongate mounting portion seating flat against and secured to said stud side and an end portion at one end of said mounting portion disposed laterally beyond the stud and projecting toward the opposite side of the stud, and said clip magnetic means is mounted on said bracket end portion and has a surface substantially coplanar with said bracket mounting portion and contacting said panel magnetic means to hold said panel in close proximity to said stud.

3. The subject matter of claim 2, wherein:

said clip bracket is non-magnetic and said clip magnetic means is loosely mounted on said bracket for limited floating movement relative to the bracket edgewise of said panel.

4. The subject matter of claim 2, wherein:

said bracket end portion has a terminal section substantially parallel to and offset toward said opposite stud side relative to said bracket mounting portion, and said clip magnetic means comprises a flat magnet disposed with its side faces substantially parallel to said terminal section of said bracket end portion and with one side face in contact with said panel magnetic member.

5. The subject matter of claim 2, wherein:

said bracket end portion has a section disposed at right angles to said bracket mounting portion, and said clip magnetic means comprises a flat magnet disposed with its side faces generally parallel to said right angle section of said bracket end portion and having an edge surface in contact with said panel magnetic member.

6. The subject matter of claim 5, wherein:

said magnet is secured to said right angle bracket end portion by a fastener which extends through the magnet normal to its side faces and along which the magnet can undergo limited floating movement.

7. A wall assembly comprising:

a stud, a pair of wall panels disposed edge to edge with adjacent edge portions of the panels overlying one side of the stud, at least one magnetic clip on said stud including a non-magnetic bracket fixed to said stud side, and magnetic means mounted on said bracket, magnetic means on said panel edge portions magnetically secured to said clip magnetic means, and wherein said clip magnetic means are mounted on said bracket for limiting floating movement relative to the bracket edgewise of said panels.

8. A wall assembly comprising:

a stud, a pair of wall panels disposed edge to edge with adjacent edge portions of the panels overlying one side of the stud, at least one magnetic clip on said stud including a bracket fixed to said stud side, and magnetic means mounted on said bracket, magnetic means on said panel edge portions magnetically secured to said clip magnetic means, said clip bracket has a flat elongate central mounting portion seating flat against and secured to said stud side and opposite end portions at opposite ends of said mounting portion disposed laterally beyond and projecting toward the opposite side of the stud, and said clip magnet means comprise magnetic means mounted on said bracket end portions having surfaces which are substantially coplanar with one another and with said bracket mounting portion and disposed in contact with said panel magnetic means, respectively, to hold said panels close to said stud.

9. The subject matter of claim 8, wherein:

said clip bracket is non-magnetic and said clip magnetic means are mounted on said bracket for limited floating movement relative to the bracket edgewise of said panels.

10. The subject matter of claim 8, wherein:

said bracket end portions have sections disposed at right angles to said bracket mounting portion, and said clip magnetic means comprise flat magnets secured to said right angle bracket sections, respectively, with their side faces generally parallel to said sections and having edge surfaces in contact with said panel magnetic members, respectively.

11. The subject matter of claim 8, wherein:

said bracket end portions have terminal portions, respectively, substantially parallel to and offset toward said opposite stud side relative to said bracket mounting portion, and said clip magnetic means comprise flat magnets disposed with their side faces substantially parallel to said terminal sections of said bracket end portion and with side faces of the magnets in contact with said panel magnetic members, respectively.

12. A wall assembly comprising:

a floor runner to be secured to a floor, a header to be secured to a ceiling over and parallel to the floor runner, studs extending between and spaced along said runner and header, panels extending between and disposed edge to edge along said runner and header with adjacent edge portions of adjacent panels overlying one side of a common stud, magnetic clips spaced along each stud, each including a non-magnetic bracket fixed to said side of the respective stud and magnetic means mounted on said bracket, magnetic means on said panel edge portions magnetically secured to the adjacent magnetic clips, and wherein said magnetic means of each magnetic clip is mounted on the bracket for limited floating movement edgewise of said panels.

13. A wall assembly comprising:

a floor runner to be secured to a floor, a header to be secured to a ceiling over and parallel to the floor runner, studs extending between and spaced along said runner and header, panels extending between and disposed edge to edge along said runner and header with adjacent edge portions of adjacent panels overlying one side of a common stud, magnetic clips spaced along each stud, each including a bracket fixed to said side of the respective stud and magnetic means mounted on said bracket, magnetic means on said panel edge portions magnetically secured to the adjacent magnetic clips, the bracket of each magnetic clip has a flat elongate central mounting portion seating flat against and secured to said side of the respective stud and opposite end portions at opposite ends of said central mounting portion and protecting toward the opposite side of the respective stud, and said magnetic means of each magnetic clip comprise magnetic means on said bracket end portions having surfaces substantially coplanar with one another and with said mounting portion of the respective mounting bracket and disposed in contact with said magnetic means on the adjacent panels for holding the panels close to the studs.

14. The subject matter of claim 13, wherein:

said bracket end portions have sections disposed at right angles to said bracket mounting portion, and said clip magnetic means comprise flat magnets secured to said right angle bracket sections, respectively, with their side faces generally parallel to said sections and having edge surface in contact with said panel magnetic members, respectively,

15. The subject matter of claim 13, wherein:

said bracket end portions have terminal portions, respectively, substantially parallel to and offset toward said opposite stud side relative to said bracket mounting portion, and said clip magnetic means comprise flat magnets disposed with their side faces substantially parallel to said terminal sections of said bracket end portions and with side faces of the magnets in contact with said panel magnetic members, respectively.

* * * * *